US010434770B2

(12) United States Patent
Clark et al.

(10) Patent No.: US 10,434,770 B2
(45) Date of Patent: Oct. 8, 2019

(54) PRINTING ELEMENT TEMPERATURE ADJUSTMENT

(71) Applicant: HEWLETT-PACKARD DEVELOPMENT COMPANY, L.P., Houston, TX (US)

(72) Inventors: Garrett E. Clark, Corvallis, OR (US); Michael W. Cumbie, Corvallis, OR (US); Mark H. MacKenzie, Vancouver, WA (US); Jose Luis Valero, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/570,827

(22) PCT Filed: Jul. 29, 2015

(86) PCT No.: PCT/US2015/042710
§ 371 (c)(1),
(2) Date: Oct. 31, 2017

(87) PCT Pub. No.: WO2017/019065
PCT Pub. Date: Feb. 2, 2017

(65) Prior Publication Data

US 2018/0147841 A1 May 31, 2018

(51) Int. Cl.

| | |
|---|---|
| ***B41J 2/045*** | (2006.01) |
| ***B41J 2/14*** | (2006.01) |
| ***B41J 2/155*** | (2006.01) |

(52) U.S. Cl.
CPC ..... *B41J 2/04563* (2013.01); *B41J 2/0458* (2013.01); *B41J 2/04508* (2013.01); *B41J 2/14153* (2013.01); *B41J 2/155* (2013.01)

(58) Field of Classification Search
CPC .. B41J 2/04563; B41J 2/0458; B41J 2/04508; B41J 2/14153
See application file for complete search history.

(56) References Cited

U.S. PATENT DOCUMENTS

| | | | | |
|---|---|---|---|---|
| 6,178,299 | B1 | 1/2001 | Kim | |
| 6,641,243 | B2 | 11/2003 | Anderson et al. | |
| 7,669,956 | B2 | 3/2010 | Sheahan et al. | |
| 7,699,424 | B2 | 4/2010 | Shihoh et al. | |
| 8,931,875 | B2 | 1/2015 | Kosaka et al. | |
| 2002/0067384 | A1* | 6/2002 | Anderson | B41J 2/04528 347/17 |
| 2006/0284915 | A1 | 12/2006 | Han | |
| 2007/0120884 | A1 | 5/2007 | Lecheheb | |
| 2007/0291081 | A1 | 12/2007 | Kanno et al. | |
| 2009/0179937 | A1 | 7/2009 | Yamada | |
| 2011/0279166 | A1* | 11/2011 | Umeda | H05K 1/025 327/365 |
| 2013/0093809 | A1 | 4/2013 | Kosaka et al. | |
| 2013/0155142 | A1 | 6/2013 | Browning et al. | |
| 2013/0321507 | A1 | 12/2013 | Mardilovich et al. | |
| 2015/0002569 | A1 | 1/2015 | Tsuchiya et al. | |
| 2016/0257114 | A1* | 9/2016 | Yokozawa | B41J 2/04551 |

* cited by examiner

*Primary Examiner* — Scott A Richmond
(74) *Attorney, Agent, or Firm* — HP Inc. Patent Department

(57) ABSTRACT

A temperature of one printing element is adjusted based upon a temperature of another of printing element.

19 Claims, 5 Drawing Sheets

PRINTING ELEMENT TEMPERATURE ADJUSTMENT

BACKGROUND

Thermal fluid droplet ejection print heads print by vaporizing ink to create a vapor bubble which ejects droplets of fluid, such as ink. Existing thermal fluid droplet ejection print heads sometimes experience printing density variations and hue shift.

DETAILED DESCRIPTION OF EXAMPLES

Figure 1:
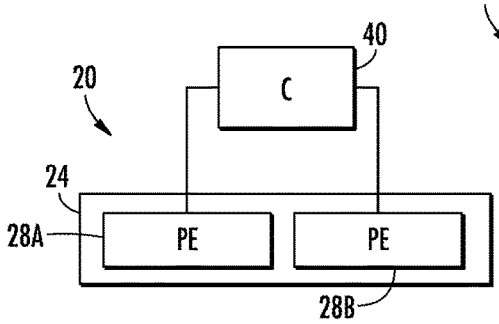
FIG. 1 is a schematic diagram of an example thermal fluid droplet ejection printing system.

FIG. 1 schematically illustrates an example thermal fluid droplet ejection printing system 20. As will be described hereafter, thermal fluid droplet ejection printing system 20 adjusts a temperature or temperatures of a printing element based on the temperature or temperatures of another printing element to enhance print quality by reducing printing density variations and/or by reducing hue shift. Thermal fluid droplet ejection printing system 20 comprises support 24, printing elements 28A, 28B (collectively referred to as printing elements 28) and controller 40.

Support 24 comprises a structure that supports printing elements 28 in close proximity or adjacent one another. In one implementation, support 24 comprises a printhead. In one implementation, support 24 comprises silicon. In another implementation, support 24 comprises an epoxy mold compound. In one implementation, in addition to supporting printing elements 28, support 24 also supports controller 40, such as with a chip on board (COB) architecture.

Printing elements 28 comprise individual or independent structures that selectively eject droplets of fluid, such as ink. Printing elements 28 are mounted to or connected to support 24 proximate or adjacent to one another. In one implementation, each of printing elements 20 comprises an individual printing die or sliver formed from a wafer of multiple such dies or slivers. In one implementation, each of printing elements 28 comprises a silicon die in which is formed a slot or multiple slots, wherein each slot is supplied with the ink or fluid from a fluid source and wherein each slot directs the ink or fluid to firing chambers. Each firing chamber contains a thermal fluid droplet ejection resistor that, upon being actuated, heats the fluid to a temperature above a nucleation temperature of the fluid to vaporize the fluid and form a vapor bubble that ejects a droplet of the ink or fluid through a corresponding nozzle.

In one implementation, each printing element 28 is dedicated to printing a single assigned color of ink, such as cyan, magenta, yellow or black ink. For example, in one implementation, each printing element includes a slot or multiple slots extending lengthwise along the printing element and which receive the same color of ink from a single fluid source. In yet another implementation, each printing element 28 includes multiple slots extending lengthwise along the printing element and which receive different colors of ink from different fluid sources.

Although system 20 is schematically illustrated as comprising two printing elements 28 arranged end-to-end, in other implementations, printing elements 28 may have other relationships. For example, printing elements 28 may be arranged parallel or side-by-side with the major dimensions of such printing elements spaced from one another, but parallel to one another in an aligned or staggered column. In some implementations, system 20 may comprise more than two such printing elements 28 arranged in multiple rows and multiple columns. In one implementation, such printing elements are arranged in a staggered arrangement along a length of support 24.

In one implementation, each of printing elements 28 has a thickness of less than or equal to 300 μm and a width of less than or equal to 500 μm, wherein the nozzles and the slot or slot extend along a length or longitude (the major dimension) of the printing element. In such implementations, the relatively small amount or volume of silicon forming the die of each printing element 28 has a limited ability to thermally conduct heat lengthwise along the individual printing element 28, rendering printing element 28 more susceptible temperature variations along its length and relative to other adjacent printing elements 28. The lower silicon mass (the result of the very narrow and thin printing elements or slivers) may produce higher temperature variations as compared to system with larger thermal mass. Such temperature variations may lead to the ejection of droplets having disparate volumes of ink, leading to printing density variations and/or hue shift.

Figure 2:
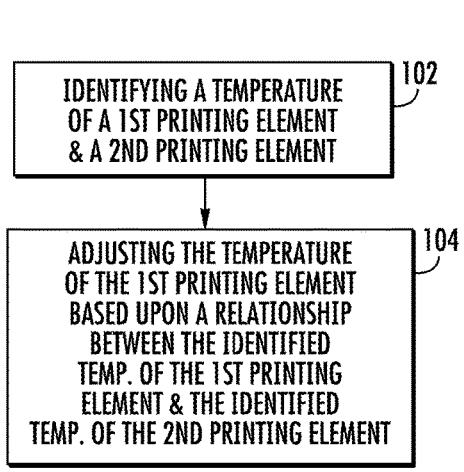
FIG. 2 is a flow diagram of an example method for temperature control of printing elements.

Controller 40 comprises a device that is to carry out example method 100 outlined in FIG. 2. In one implementation, controller 40 comprises a processing unit that carries out example method 100 outlined in FIG. 2. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 40 may be embodied as part of one or more application-specific integrated circuits (ASICs). Unless otherwise specifically noted, the controller is not limited to any specific combination of hardware circuitry and software, nor to any particular source for the instructions executed by the processing unit.

As indicated by block 102 of FIG. 2, controller 40 identifies a temperature associated with each of printing elements 28. In one implementation, controller 40 receives signals from temperature sensors associated with printing elements 28. In one implementation, each printing element 28 has an assigned temperature sensor. In another implementation, each printing element 28 has multiple assigned temperature sensors that indicate temperatures of different regions or zones of the respective printing element 28.

In one implementation, each printing element 28, when not printing, is maintained at a minimum reference temperature. In other words, controller 40 automatically actuates heating devices to maintain that idle printheads at the minimum reference temperature. In one implementation, controller 40 supplies electrical current to the thermal fluid droplet ejection resistor at a level such that the thermal fluid droplet ejection resistor does not generate sufficient heat to produce a bubble or nucleated the adjacent ink or fluid, but sufficient heat to warm the printing element and maintain the printing element at a minimum reference temperature. In such an implementation, the temperature of a printing element 28 may be determined by controller 40 determining that the printing element 28 has been idle for a predefined period of time such that the printing element will therefore be at the minimum default reference temperature.

In yet another implementation, controller 40 identifies a temperature of each of the printing elements 28 by estimating a temperature of each of printing elements 28 based upon the historical or recent fluid droplet or ink droplet firing activity of the individual printing element 28. For example, in one implementation, controller 40 analyzes recent printing activity, such as different characteristics of the image or text being printed, including one or both of location and color, to determine the frequency at which the different nozzles have been actuated or fired. Based upon the different firing times and frequencies of the different thermal fluid droplet ejection resistors and their associated nozzles, controller 40 estimates the temperature of each printing element 28 or the temperatures of the different zones or regions of each printing element 28. In one implementation, controller 40 may consult a digitally stored lookup table associating different temperatures with different historical firing frequencies or patterns of firing frequencies. In another implementation controller 40 may apply one or more algorithms or formulas which estimate temperature for the printing element or portions of the printing element based upon inputs such as the frequency and timing of fluid or ink ejections by the printing element. For purposes of this disclosure, a "determined temperature" of a printing element or "identified temperature" of a printing element encompasses sensing of a temperature, estimation of a temperature based upon use and/or use of the predetermined default reference temperature at which the printing elements 28 are automatically maintained.

As indicated by block 104 in FIG. 2, controller 40 utilizes the identified temperatures of the first printing element 28 and the second printing element 28 to identify or determine a relationship between the identified temperatures of the different printing elements 28. Through such a comparison, controller 40 may determine that one printing element 28 is at a higher temperature than the other printing element 28. Based upon the identified relationship between the identified temperatures of the different printing elements 28, controller 40 outputs control signals that adjust the temperature of the first printing element, printing element 28A or printing element 28B, to reduce temperature differences between the two adjacent or proximate printing elements 28. By reducing the temperature differences between the two adjacent approximate print elements 28, controller 40 reduces print density variations and/or hue shift.

In one implementation, the control signals output by controller 40 upwardly adjust a temperature of the printing element 28 or portions of the printing element 28 that has an identified temperature that is less than the adjacent printing element 28. In one implementation, the control signals cause the thermal fluid droplet ejection droplet ejection resistors within the firing chambers of the printing element to be provided with sub apparent nucleation threshold (ANT) energy pulses that provide non-fluid ejecting heat, resulting in the thermal fluid droplet ejection firing resistors warming to a maximum temperature that is below the homogenous nucleation temperature (below the temperature which bubble formation occurs or at which the liquid is vaporized to form a bubble) of the ink or fluid within the firing chamber without nucleating the fluid or ink within the firing chamber. In one implementation, the thermal fluid droplet ejection droplet ejection resistors are heated with a maximum energy less than or equal to about 75% of the ANT energy such that portions of the associated printing element are heated or warmed to a maximum temperature that is insufficient to cause ejection of a droplet.

In another implementation, the control signals output by controller 40 actuate a thermal fluid droplet ejection resistor that is located to serve as an inertial pump for the printing element. For purposes of this disclosure, the term "inertial pump" refers to a pumping device that initially drives fluid in both directions within a channel that is relatively narrow towards the destination it connects, but wherein the pumping device is asymmetrically positioned between the origin and destination such that the end result is fluid being driven in a direction towards the most distant fluid volume, the fluid destination. In one implementation, a thermal fluid droplet ejection inertial pump resistor is heated, through the supply of electric current across the resistor, to a temperature sufficient to vaporize adjacent fluid to create an air bubble which outwardly displaces surrounding fluid and wherein collapse of the air bubble creates a void of negative pressure which draws in adjacent fluid. In one implementation, actuation of the thermal fluid droplet ejection inertial pump resistor serves dual functions: selectively heating portions of the associated printing element and pumping fluid or ink within the associated printing element so as to mix the fluid or ink. In one implementation, in circumstances where mixing is not desired, but where heating is desired, the control signals may cause the thermal fluid droplet ejection inertial pump resistors to be heated with sub apparent nucleation threshold (ANT) energy pulses that result in the thermal fluid droplet ejection inertial pump resistors warming to a temperature that is below the homogenous nucleation temperature (below the temperature which bubble formation occurs or at which the liquid is vaporized to form a bubble) of the ink or fluid without nucleating the fluid or ink adjacent to such resistors.

In yet other implementations, the control signals output by controller 40 direct other independent heaters to selectively heat either or both of printing elements 28A, 28B. For example, in one implementation, printing elements 28 may incorporate other electrically resistive elements through which current is supplied to generate heat or other heating elements. For example, in one implementation, the transistors of each of the printing elements 28, which control the firing of the thermal fluid droplet ejection drop ejector resistors, may be used as heating devices to selectively apply heat to the respective printing element 28. In one implementation, each of printing elements 28 comprises multiple heating elements or devices (thermal fluid droplet ejection drop ejection resistors, thermal fluid droplet ejection inertial pump resistors or other independent resistors or heaters) that are independently actuatable to selectively generate and apply heat to distinct associated portions or zones of the associated printing element 28. In such an implementation, different portions of each printing element may be heated differently to different temperatures. In some implications, some portions may not be heated while other portions are heated. In one implementation, such portions serially extend along a longitudinal length/major dimension of each of printing elements 28.

Figure 3:
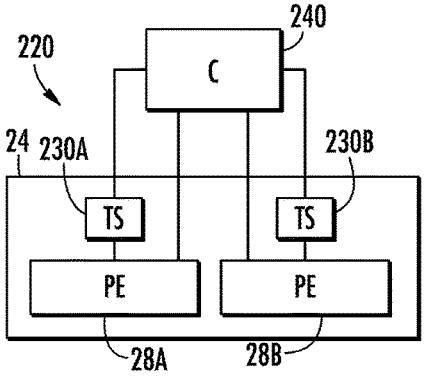
FIG. 3 is a schematic diagram of another example thermal fluid droplet ejection printing system.

FIG. 3 schematically illustrates thermal fluid droplet ejection printing system 220, another implementation of system 20. System 220 is similar to system 20 except that system 220 is specifically illustrated as comprising temperature sensors 230A, 230B (collectively referred to as sensors 230) and controller 240. Those remaining elements or components of system 220 which correspond to components of system 20 are numbered similarly.

Temperature sensors 230 comprise devices that output signals indicating or corresponding to a temperature of at least one portion of the associated printing element 28. In one implementation, each of temperature sensors 230 comprises multiple sensing elements that output signals indicating variations in temperature along the longitudinal length (the major dimension) of the associated printing element 28A, 28B. In other implementations, each of temperature sensors 230 comprises an individual temperature sensing element which senses the temperature across the associated printing element 28.

Controller 240 is similar to controller 40 except that controller 240 identifies a temperature of printing elements 28 based upon signals received from temperature sensors 230 (according to block 102 in method 100 in FIG. 2). Thereafter, controller 240 carries out block 104 in method 100 of FIG. 2 by adjusting the temperature of at least one of printing elements 28 based upon a relationship or a comparison between the identified temperatures of printing elements 28 based upon the signals received from temperature sensors 230.

Figure 4:
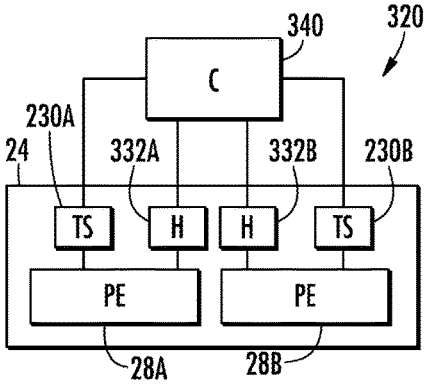
FIG. 4 is a schematic diagram of another example thermal fluid droplet ejection printing system.

FIG. 4 schematically illustrates thermal fluid droplet ejection printing system 320, another implementation of system 20. System 320 is similar to system 220 except that system 320 is specifically illustrated as specifically comprising heaters 332A, 332B (collectively referred to as heaters 332). Those remaining elements or components of system 320 which correspond to components of system to 20 are numbered similarly.

Heaters 332A, 332B comprise devices to selectively apply heat to printing elements 28A and 28B, respectively. In one implementation, each of heaters 332 comprises multiple distinct and independently actuatable heating elements to differently apply heat to different portions of a single printing element 28. In one implementation, heaters 332 are arranged to differently heat different longitudinal zones or regions along the launched a length of major dimension of the associated printing element 28.

In one implementation, heaters 332 each comprise thermal fluid droplet ejection inertial pump resistors located to serve as inertial pumps for moving link or fluid within the associated printing element 28. In another implementation, heaters 332 each comprise other independent heating elements such as other resistors which generate heat, but at sub ANT energy levels. For example, in one implementation, heaters 332 may comprise the transistors that are used to control firing of the thermal fluid droplet ejection drop ejector resistors of the printing element 28. In some implementations, heaters 332 may be omitted where system 320 utilizes the thermal fluid droplet ejection drop ejector resistors already present on the printing elements 28.

Controller 340 is similar to controller 240 except that controller 340 outputs control signals the control or actuate heaters 332 to adjust the temperatures of the different printing elements 28 based on the temperature indicating signals received from temperature sensors 230. In each of the implementations shown FIGS. 3 and 4, controller 240, 340 may, in some implementations, be incorporated as part of or integrated onto the support 24.

Figure 5:
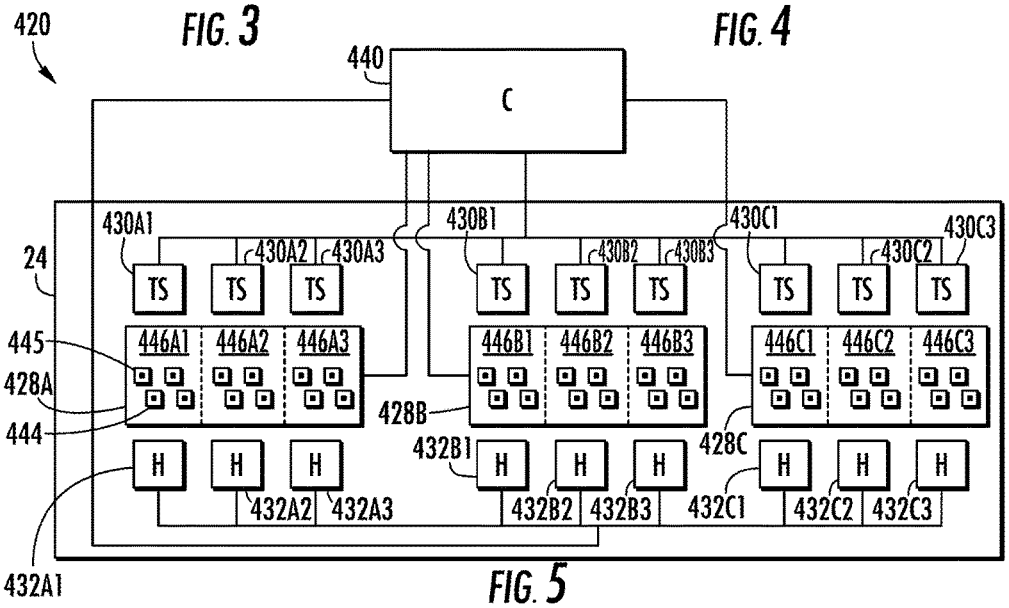
FIG. 5 is a schematic diagram of another example thermal fluid droplet ejection printing system.

FIG. 5 schematically illustrates thermal fluid droplet ejection printing system 420, another implementation of system 20. System 420 comprises support 24, printing elements 428A, 428B, 428C (collectively referred to as printing elements 428), temperature sensors 430A1, 430A2, 430A3 (collectively referred to as temperature sensors 430A), 430B1, 430B2, 430B3 (collectively referred to as temperature sensors 430B), and 430C1, 430C2, 430C3 (collectively referred to as temperature sensors 430C) (all of sensors 430A, 430B, 430C collectively referred to as temperature sensors 430), heaters 432A1, 432A2, 432A3 (collectively referred to as heaters 432A), 432B1, 432B2, 432B3 (collectively referred to as heaters 432B), and 432C1, 432C2, 432C3 (collectively referred to as heaters 432C) (all of heaters 432A, 432B, 432C collectively referred to as heaters 432) and controller 440.

Support 24 is described above and supports each of printing elements 428, temperature sensors 430 and heaters 432. In one implementation, support 424 further supports controller 440. In one implementation, support 24 supports a sufficient number of printing elements 428 to print across the entire width of printing media to form a page wide array printer. In other implementations, support 24 is supported by a carriage that scans or moves support 24 relative to an underlying print media.

Printing elements 428 are similar to printing elements 28 described above. In the example illustrated in FIG. 5, each of printing elements 428 comprises a pair of rows of nozzles 444 which extend along the longitudinal length or major dimension of the printing element and which are longitudinally staggered relative to one another. Each of such nozzles 444 has an associated firing chamber and thermal fluid droplet ejection firing or drop ejection resistor 445 that upon being appropriately actuated in response to signals from controller 440, creates a vapor bubble to eject fluid or ink through the associated one of nozzles 444.

Temperature sensors 430 and heaters 432 are similar to temperature sensors 230 and 332 described above except that temperature sensors 430 and heaters 432 are specifically illustrated as being assigned or associated with specific regions or zones of their respective printing elements 428. In the example illustrated, temperature sensors 430A1, 430A2, 430A3 are assigned to and independently sense temperatures associated with zones 446A1, 446A2 and 446A3, respectively. Temperature sensors 430B1, 430B2, 43063 are assigned to an independently sense temperatures associated with zones 446B1, 446B2 and 446B3, respectively. Temperature sensors 430C1, 430C2, 430C3 are assigned to an independently sense temperatures associated with zones 446C1, 446C2 and 446C3, respectively. Likewise, heaters 432A1, 432A2, 432A3 independently heat zones 446A1, 446A2 and 446A3, respectively; heaters 432B1, 432B2, 432B3 independently heat zones 446B1, 446B2 and 446B3, respectively; and heaters 432C1, 432C2, 432C3 independently heat zones 446C1, 446C2 and 446C3, respectively. Although zones 446 are each illustrated as being uniformly sized with respect to one another, in other implementations, different zones may have different sizes. For example in some implementations, end most zones of a printing element 428 (those zones close to the launch to and of the printing element) may be smaller in size (containing fewer nozzles and/or fewer thermal fluid droplet ejection droplet ejection resistors) as compared to the intermediate or central zones which may involve fewer temperature adjustments. In some implementations, the size of the zones decreases as zones approach the ends of the printing elements, closer to other printing elements, providing greater resolution for temperature adjustments and control for those zones closer to adjacent printing elements. In some implementations, heaters 432 are omitted where the thermal fluid droplet ejection drop ejection resistors 445, already provided on the printing elements, serve as the heaters, wherein temperature adjustments are made by heating such thermal fluid droplet ejection drop ejection resistors 445 to maximum temperatures above which would vaporize the ink or fluid and eject a fluid droplet.

Controller 440 is similar to controller 340 described above. Controller 440 identifies a temperatures of each of the zones 446 based upon signals received from the associated temperature sensors 430. Based upon the relationship or a comparison of identified temperatures of the different zones 446 across multiple printing elements 428, controller 440 adjusts the temperature of a zone or multiple zones to reduce temperature gradients across the multiple printing elements and/or to smooth out or make more gradual any temperature differences or deltas from one printing element 428 to another adjacent printing element 428.

By way of example, in one implementation, upon receiving signals from sensors 430*a*3 and 430B1 indicating that zone 446B1 is at a much higher temperature relative to zone 446A3, controller 440 may output control signals to heater 432A3 to elevate a temperature of zone 446A3 so as to have a temperature closer to the temperature of zone 446B1. At the same time, upon receiving signals from temperature sensors 430B3 and 430C1 indicating that zone 446C1 is at a much higher temperatures than zone 446B3, controller 440 may output control signals to heater 432B3 to elevate a temperature of zone 446B3 to a temperature closer to the temperature of zone 446C1. Alternatively, upon receiving signals from temperature sensors 430B3 and 430C1 indicating that zone 446C1 is at a much lower temperatures than zone 446B3, controller 440 may output control signals to heater 432C1 to elevate a temperature of zone 446C1 to a temperature closer to the temperature of zone 446B3. In some circumstances, where both of the end most zones of a printing element 428 are upwardly adjusted in temperature, controller 440 may output control signals to those heaters associated with the intermediate or more central zones of the printing element such that the intermediate or more central zones of the printing element have temperatures closer to or more uniform with the temperatures of the end most zones to reduce print density differences along the individual printing element itself. For example, in one implementation in which first and second cool zones, being maintained at the minimum reference temperature, reside next to a much warmer zone, the middle second cool zone may be warmed to a temperature above the reference temperature, such as halfway between the first cool zone (at the minimum reference temperature) and the temperature (such as the average temperature) of the warmer zone. In one implementation, controller 440 elevates a temperature of zones having lower temperatures relative to zones of adjacent printing elements within predefined limits to prevent uncontrolled heating escalation across the system.

In the above example, each of printing elements 428 is partitioned into three separate zones that may be individually sensed, adjusted and controlled by controller 440. In one implementation, each zone is associated with a single temperature sensor 430. In another implementation, each zone is associated with multiple temperature sensors, wherein an average or some other statistical value based upon temperature readings from the multiple temperature sensors is used as the identified temperature of the zone. In other implementations, each of such printing elements 428 may be partitioned into other numbers of zone. For example, each of printing of 428 may be partitioned into two zones or greater than three zones. In one implementation, the number of zones may be equal to the number of individual heaters on the printing element 428 such as the number of individual thermal fluid droplet ejection firing resistors along the printing element 28. As the number of zones along a particular printer 428 increases, the ability to more precisely control temperature along the printing element 428 also increases. By increasing the number of zones, the resolution by which temperature adjustments along the printing element 428 also increases to facilitate a smoother temperature gradient along the printing element are between printing elements.

In the example illustrated, each printing element 428 is partitioned into three equally sized zones. In other implementations, each printing element 428 may be partitioned into non-uniformly sized zones, wherein larger zones contain a larger number of nozzles 444 and thermal fluid droplet ejection droplet ejecting resistor 445 as compared to smaller sized zones. By varying the size of the zones along an individual printing element 428, those zones in regions where temperature gradients are more likely to be larger may be sized smaller to provide finer or more precise temperature adjustments in such regions. For example, end portions of a printing element may have a tendency to experience greater temperature gradients due to a lower available mass for thermally conducting heat or due to such portions being adjacent to distinct printing elements. In such circumstances, those end portions of the printing element may be provided with a greater density or number of zones for a given surface area as compared to more central regions of the printing element less likely to experience large temperature gradients. For example, end portions of the printing element may be provided with X zones per unit area while central portions of the printing element are provided with Y zones per unit area, wherein the number X is greater than the number Y. in one implementation, each zone may have the same number of temperature sensors, resulting in smaller zones having a greater density of temperature sensors. In other implementations, each zone may have the same density of temperature sensors (temperature sensors per unit area).

Figure 6:
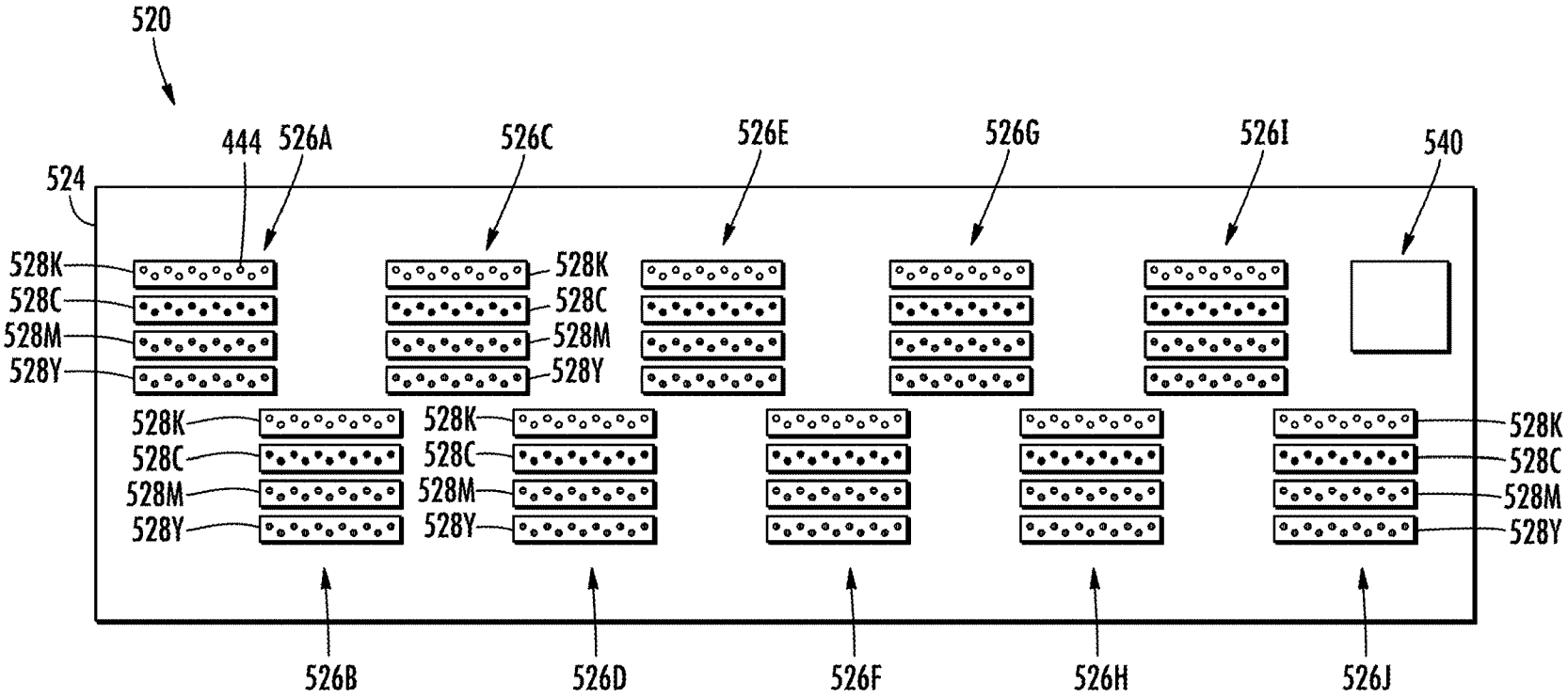
FIG. 6 is a schematic diagram of another example thermal fluid droplet ejection printing system.

FIG. 6 illustrates thermal fluid droplet ejection printing system 520, another example of system 20. System 520 comprises support 524, squads 526A-526J (collectively referred to as squads 526) of printing elements 528 and controller 540. Support 524 is similar to support 24 described above. In one implementation, support 524 is formed from silicon. In another implementation, support 524 is formed from an epoxy mold compound. Support 524 supports each of the squads 526 as well as controller 540. In one implementation of support 524 comprises a printhead.

In one implementation, support 524 supports a sufficient number of printing elements 528 to print across the entire width of printing media to form a page wide array printer. In other implementations, support 524 is supported by a carriage that scans or moves support 524 relative to an underlying print media.

Squads 526 comprises a set of four individual printing elements 528: printing element 528K, printing element 528C, printing element 528M and printing element 528Y (such individual printing elements sometimes referred to as slivers). Each printing element comprises an individual silicon die upon which circuitry is fabricated. In one implementation, each printing element or sliver 528 is cut from a silicon wafer.

Printing element 528K is dedicated to printing black ink and comprises an ink feed slot that supplies black ink to two staggered rows of nozzles 444 extending along its longitudinal length, each nozzle 444 being associated with a corresponding thermal fluid droplet ejection droplet ejecting resistor 445 (described and illustrated above). Printing element 528C is dedicated to printing cyan ink and comprises an ink feed slot that supplies cyan ink to two staggered rows of nozzles 444 extending along its longitudinal length, each nozzle 444 being associated with a corresponding thermal fluid droplet ejection droplet ejecting resistor 445 (described and illustrated above). Printing element 528M is dedicated to printing magenta ink and comprises an ink feed slot that supplies magenta ink to two staggered rows of nozzles 444 extending along its longitudinal length, each nozzle 444 being associated with a corresponding thermal fluid droplet ejection droplet ejecting resistor 445 described and illustrated above. Printing element 528Y is dedicated to printing yellow ink and comprises an ink feed slot that supplies yellow ink to two staggered rows of nozzles 444 extending along its longitudinal length, each nozzle 444 being associated with a corresponding thermal fluid droplet ejection droplet ejecting resistor 445 (described and illustrated above).

Each printing element 528 is partitioned into at least three different longitudinally arranged regions, portions or thermal zones including end most zones located on the far outer ends of each printing element 528 (adjacent the far left edge and the far right edge of each printing element 528) with at least one intermediate zone therebetween. Each of such zones has an associated temperature sensor and an associated heating device. In one implementation, the associated heating device comprises the thermal fluid droplet ejection drop ejecting or ejection resistors 445 which are actuated to apply non-fluid ejecting heat. In another implementation, each associated heating device comprises a heating device independent of the thermal fluid droplet ejection drop ejecting resistors 445, such as a thermal fluid droplet ejection inertial pump resistor or another independent heating device. In some implementations, both the thermal fluid droplet ejection drop ejecting resistors and other independent heating devices may be used in conjunction with one another to selectively apply heat to an associated zone.

Controller 540 is similar to controller 440 described above. In the example illustrated, controller 540 comprises an application-specific integrated circuit formed upon support 524 and in communication with each of the thermal fluid droplet ejection drop ejecting resistors 445 (shown in FIG. 5) of each nozzle 444, each of the zone temperature sensors and each of the zone heating devices. Controller 540 carries out method 100 of FIG. 2 by identifying the temperatures of each of the different zones of each of the different printing elements 528 and adjusting the temperature of individual zones of the different printing elements based upon a relationship between the identified temperatures of the different zones of the different printing elements 528. Such temperature adjustment is made by turning such heating devices on and off based upon the determined relationship between the temperatures of the different zones.

In one implementation, controller 540 adjusts the temperature of zones of printing elements that are dedicated to printing the same color of ink to reduce temperature gradients between zones of the different printing elements that print the same color of ink to reduce print density gradients or variations. In another implementation, controller 540 adjusts the temperature of adjacent printing elements of the same squad, printing elements that print different colors of ink, to reduce hue shift. In the example illustrated, controller 540 performs both of the aforementioned temperature adjustments or controls to reduce both printing density gradients or variation and hue shift.

Figure 7:
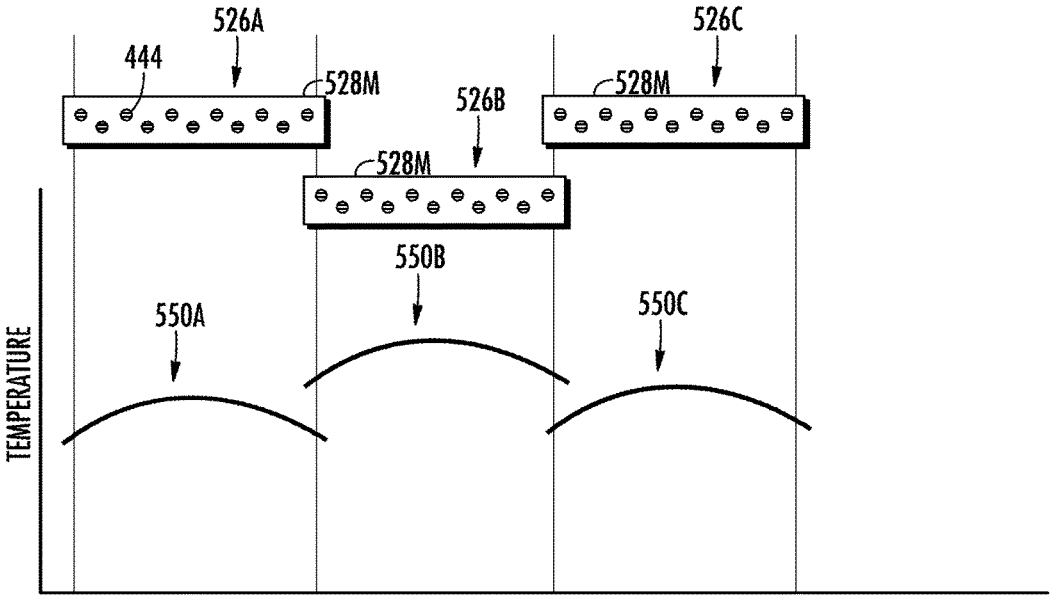
FIG. 7 is a diagram illustrating selected printing elements of the system of FIG. 6 and their associated temperature profiles.
Figure 8:
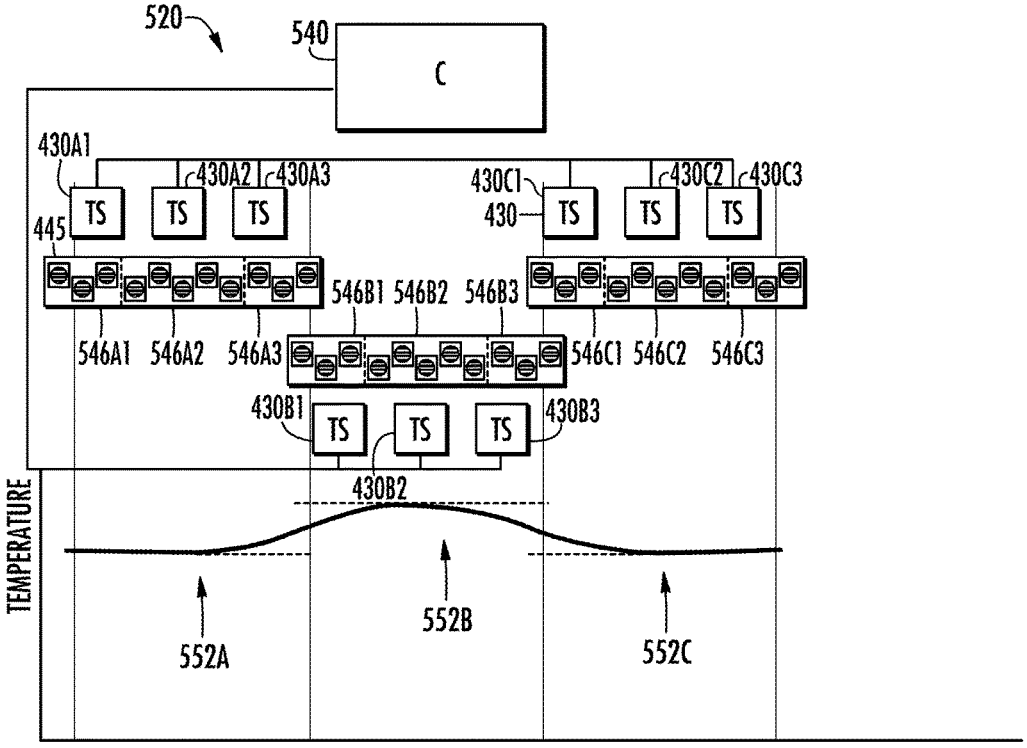
FIG. 8 is a diagram illustrating the printing elements of FIG. 7 and their temperature profiles following adjustment by the thermal fluid droplet ejection printing system.

FIGS. 7 and 8 illustrate temperature monitoring and control by controller 540 to reduce temperature deltas between zones of different printing elements that print the same color of ink to reduce printing density variations. FIG. 7 illustrates printing elements 528M of three consecutive adjacent squads 526A, 528K and 528C and their associated temperature profiles 550A, 550B and 550C (collectively referred to as temperature profiles 550), respectively, that occur in response to an equal number of droplet ejection by the nozzles across into the printing element 528M during a period of time without temperature adjustment by controller 540. As shown by FIG. 7, each temperature profile 550 drops or droops on opposite ends. In one implementation, the temperature droop is the result of a greater density of thermal fluid droplet ejection drop ejection nozzles near a center portion of each of printing elements 528 and additional silicon at the end of portions to thermally conduct heat (the slot that feeds ink to the resistors does not extend all the way to the longitudinal ends of the printing elements). The temperature gradient within each printing element resulting in printing density variations between those different portions of print printed by the individual printing element.

In the example illustrated, the center printing element 528K is at an elevated temperature relative to printing elements 528A and 528K. In some circumstances, this may be the result of printing element 528K being centrally located and being employed a greater frequency as compared to the other two printing elements. Regardless of the reason for the temperature deltas between the printing elements and along individual printing elements themselves, such temperature gradients or deltas may produce printing density variations for the particular color printed by such printing elements (magenta in the example). In general, warmer portions of the printing element or warmer printing elements themselves may eject larger volume droplets of ink as compared to those portions of a printing element or other printing elements that are at lower temperatures. Such printing density variations may be most noticeable on a printed image at the junction of such temperature profiles, where printing by one printing element ended and where printing by the other printing element began.

FIG. 8 illustrates operation of controller 540 to reduce the temperature gradient within each of the printing elements 528M while also reducing the temperature deltas between the different printing elements 528M. In the example illustrated, in response to receiving signals from the temperature sensors 530 associated with the different zones 546 of each printing element 528 communicating the temperature profiles of FIG. 7, controller 540 outputs control signals which actuate selected thermal fluid droplet ejection droplet ejection resistors 445 to produce the modified temperature profiles 552A, 552B and 552C illustrated in FIG. 8. As shown by FIG. 8, the thermal fluid droplet ejection droplet ejection resistors 445 are selectively actuated by controller 540 to apply non-fluid ejecting heat to selected zones to reduce temperature gradients along individual printing elements 528 and to reduce or smooth out temperature deltas between adjacent zones of adjacent printing elements 528. In the example illustrated, controller 540 outputs control signals causing thermal fluid droplet ejection drop ejection resistors 445 of zone 546A1 to apply non-fluid ejecting heat to zone 546A1 to account for the temperature droop in zone 546A1 shown in FIG. 7, reducing or eliminating the temperature gradient between zones 546A1 and 546A2. Similarly, controller 540 outputs control signals causing thermal fluid droplet ejection drop ejection resistors 445 of zone 546C3 to apply non-fluid ejecting heat to zone 546C3 to account for the temperature droop in zone 546C3 shown in FIG. 7, reducing or eliminating the temperature gradient between zones 546C2 and 546C3.

To address the determined or identified temperature deltas between the printing elements 528M of squads 526A, 526B and 526C, and in particular, the temperature delta between zone 546A3 and zone 546B1 as well as the temperature delta between zone 546B3 and 546C1, controller 540 takes advantage of the existing temperature drop or droop within zones 546B1 and 546B3. Controller 540 outputs control signals actuating or causing the thermal fluid droplet ejection drop ejection resistors 445 of zones 546A3 and 546C1 to apply non-fluid ejecting heat to their respective zones so as to reduce the temperature profile shown in FIG. 8. In the example shown in FIG. 8, the control signals output by controller 540 not only account for the temperature droop in zones 546A3 and 546C1, but heat such zones to temperatures above the previously higher identified temperature of zones 546A2 and 546C2 so as to move closer to or meet the declining temperature profile of zones 546B1 and 546B3.

In the above described example, the different zones are selectively heated to reduce temperature gradients across individual printing elements 528 and to reduce or eliminate temperature deltas between different printing elements 528 by utilizing the existing thermal fluid droplet ejection drop ejecting resistors of the printing elements in the different zones. As noted above, in other implementations, additional heating devices for each of the different zones may be provided such as thermal fluid droplet ejection inertial pump resistors or other heating resistors or heating devices which are selectively and independently actuated by controller 540 to adjust the temperature of the different zones of the different printing elements 528.

In the example illustrated in FIGS. 7 and 8, the intermediate or central zones are illustrated as being at elevated temperatures relative to the adjacent zones of the individual printing elements and the center printing element of squad 526B is at an elevated temperature with respect to the adjacent printing elements 528 of squads 526A and 526C. In other circumstances, different firing frequencies and durations during printing upon a print media may result in different temperature gradients along individual printing elements and different temperature deltas between same color printing elements of consecutive or adjacent squads 526. In such circumstances, controller 540 dynamically adjusts the different temperature profiles based upon the signals received from temperature sensors 430 to output different control signals to reduce differences or level out/smooth out temperature gradients or deltas between such sensed temperatures in the different zones to reduce printing density variations between the printing elements of each of the four different colors, black, cyan, magenta and yellow. In other implementations, printing elements 528 may be dedicated to other colors or other printing elements 528 may be provided for printing additional colors or shades. In such implementations, controller 540 similarly reduces temperature gradients and temperature deltas through the control of heating devices such as the thermal fluid droplet ejection drop ejecting resistors, thermal fluid droplet ejection inertial pump resistors or other heating devices.

Figure 9:
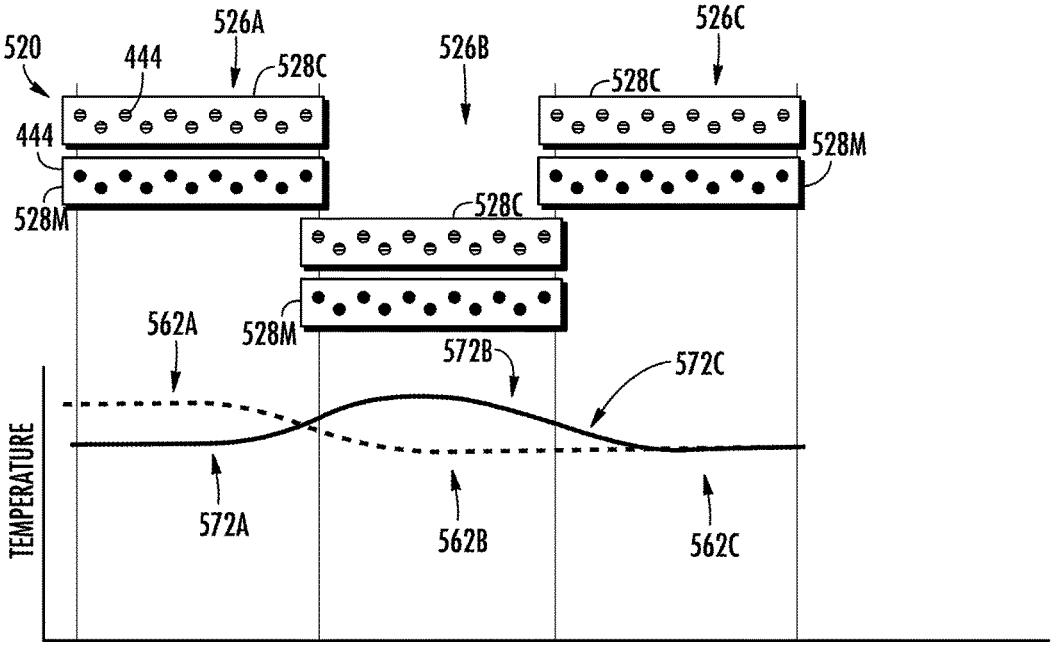
FIG. 9 is a diagram illustrating selected printing elements of the system of FIG. 6 and their associated temperature profiles.
Figure 10:
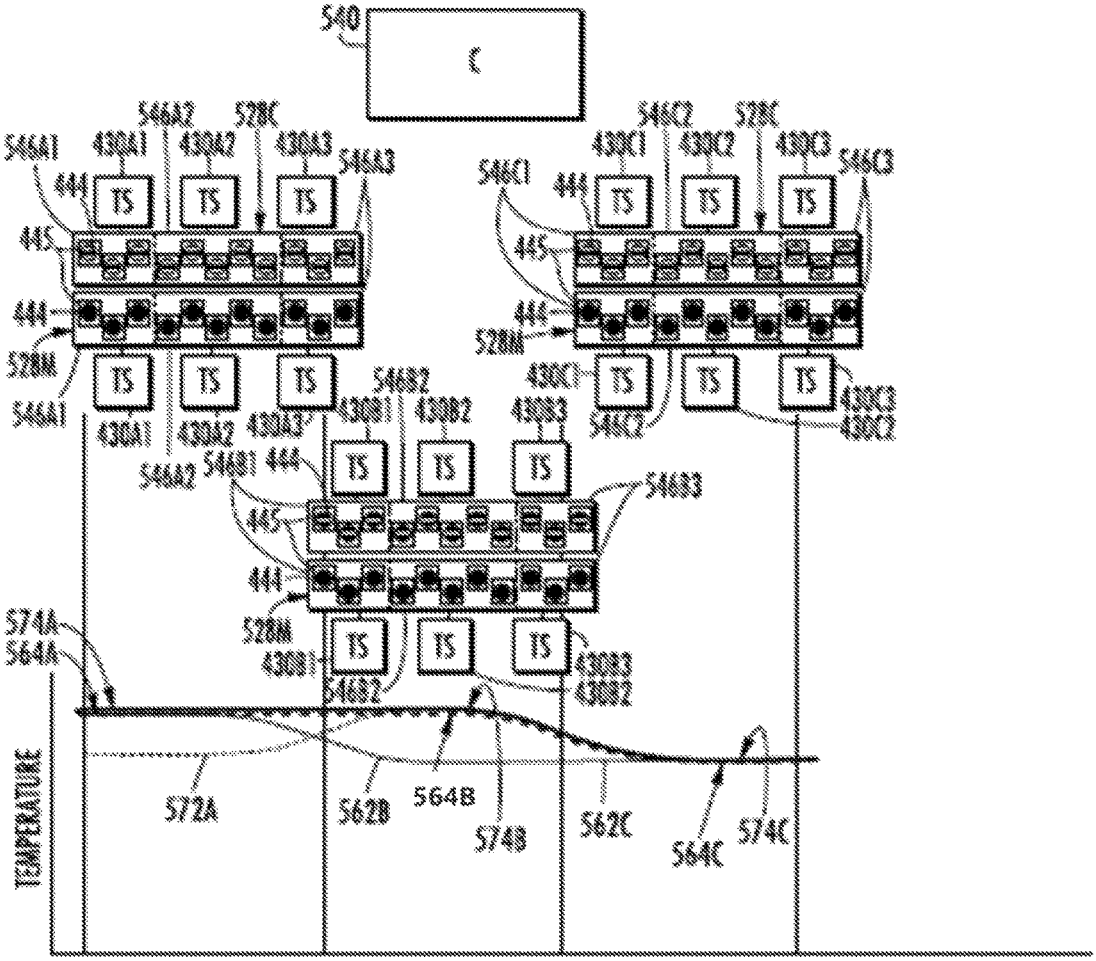
FIG. 10 is a diagram illustrating the printing elements of FIG. 9 and their temperature profiles following adjustment by the thermal fluid droplet ejection printing system.

FIGS. 9 and 10 illustrate temperature monitoring and control by controller 540 to reduce or smooth out temperature deltas between different printing elements that print different colors of ink to reduce hue shifts. FIG. 9 illustrates printing elements 528M and 528C of three consecutive adjacent squads 526A, 528K and 528C and their associated temperature profiles. In particular, FIG. 9 illustrates temperature profiles 562A, 562B and 562C (collectively referred to as temperature profiles 562) of printing elements 528C of squads 526A, 526B and 526C, respectively, after adjustment to address temperature gradients across such printing elements and temperature deltas between those printing elements 528M (in a fashion similar to described above with respect to FIG. 8). FIG. 9 further illustrates temperature profiles 572A, 572B and 572C (collectively referred to as temperature profiles 572) of printing elements 528M of squads 526A, 526B and 526C, respectively, after adjustment to address temperature gradients across such printing elements and temperature deltas between those printing elements 528C (in a fashion similar to described above with respect to FIG. 8). As shown by FIG. 9, despite adjustment of the temperatures of the different zones to address temperature gradients and deltas between the zones of individual printing elements and between different printing elements that print the same color of ink, temperature deltas may still exist between adjacent printing elements of squads 526 that print different colors of ink. Such temperature deltas may result in the size of the ink droplets of one color being different than or enlarged relative to the size of the droplets of another color such that a greater amount of one color of ink is unintentionally printed on the print media in a particular region, causing the printed image to experience a noticeable hue shift.

In the example illustrated, printing element 528C of squad 526A is at an elevated temperature relative to printing element 528M of squad 526A. in contrast, printing element 528M of squad 526B is at an elevated temperature relative to printing element 528C of squad 526B. In the example illustrated, little or no temperature deltas exist between printing elements 528M and 528C of squad 526C.

FIG. 10 illustrates operation of controller 540 to reduce the temperature deltas between the different printing elements 528M and 528C. In the example illustrated, in response to receiving signals from the temperature sensors 530 associated with the different zones 546 of each printing elements 528 communicating the temperature profiles of FIG. 9, controller 540 outputs control signals which actuate selected thermal fluid droplet ejection droplet ejection resistors 445 of selected zones to produce the modified or adjusted temperature profiles 564A, 564B, 564C (collectively referred to as profiles 564) for printing elements 528C and profiles 574A, 574B and 574C (collectively referred to as profiles 574) for printing elements 528M as shown in FIG. 10. The modified or temperature adjusted profiles 564 and 574 reduce or smooth out temperature deltas between adjacent printing elements 528 of the same squads 526 that print different colors. In the example illustrated, controller 540 outputs control signals causing thermal fluid droplet ejection drop ejection resistors 445 of zones 546A1 and 546A2 of print elements 528M of squad 526A to apply non-fluid ejecting heat to such zones to bring the temperature of such zones into closer proximity with or to substantially match the higher temperatures of zones 546A1 and 546A2 of print elements 528C of squad 526A. Similarly, controller 540 outputs control signals causing thermal fluid droplet ejection drop ejection resistors 445 of zones 546B2 and 546B3 of elements 528C of squad 526B to apply non-fluid ejecting heat to such zones to bring the temperature of such zones into closer proximity with or to substantially match the higher temperatures of zones 546B2 and 546B3 of print elements 528M of squad 526B.

The temperature adjustments to zones 546A1 and 546A2 of print elements 528M of squad 526A and to zones 546B2 and 546B3 of elements 528C of squad 526B result in temperature deltas occurring between adjacent zones of different printing elements for the same color of ink. In the example illustrated, the temperature of zones 546A2 is risen to above the temperature of zone 546A3 for each of printing elements 528C and 528M of squad 526A. Likewise, the temperature of zone 546B2 for both printing elements 528M and 528C is risen to above the temperature of zone 546B1 for each of printing elements 528C and 528M of squad 526B. The temperature of zone 546B3 of printing element 528C is risen so as to no longer be continuous and equal to the temperature of zone 546C1 of printing element 528C.

To address these temperature differentials amongst the printing elements that print the same color of ink, controller 540 outputs additional control signals to thermal fluid droplet ejection drop ejection resistors 445 (serving as temperature adjustment heating devices) of zone 546A3 for each of printing elements 528N and 528M of squad 526A to apply non-fluid ejecting heat to zone 546A3 of printing elements 528C and 528M of squad 526A to bring the temperature of 546A3 into closer proximity with or to substantially match the higher temperatures of zone 546A2 of print elements 528M and 528C of squad 526A. Likewise, controller 540 outputs additional control signals to thermal fluid droplet ejection drop ejection resistors 445 (serving temperature adjustment heating devices) of zone 546B1 for each of printing elements 528C and 528M of squad 526B to apply non-fluid ejecting heat to such zones to bring the temperature of 546B1 into closer proximity with or to substantially match the higher temperatures of zone 546B2 of print elements 528C and 528M of squad 526B. Controller 540 further outputs control signals to thermal fluid droplet ejection drop ejection resistors 445 of zone 546C1 of printing element 528C to apply non-fluid ejecting heat to zone 546C1 of printing element 528C bring the temperature of zone 546C1 of printing element 528C into closer conformity or a match with the adjusted temperature profile of zone 546B3 of printing element 528C. In the example illustrated, controller 540 adjusts temperature along the zone 546C1 such that the temperature profile of zone 546C1 of printing element 528C comprises a smooth, gradual sloping ramped temperature profile similar to the sloping or ramped temperature profile of zone 546B3 of printing element 528M.

In the above described example, the different zones are selectively heated to reduce or eliminate temperature deltas between different printing elements 528 of the same squad that eject different colors of ink by utilizing the existing thermal fluid droplet ejection drop ejecting resistors of the printing elements in the different zones. As noted above, in other implementations, additional heating devices for each of the different zones may be provided such as thermal fluid droplet ejection inertial pump resistors or other heating resistors are heating devices which are selectively and independently actual by controller 540 to adjust the temperature of the different zones of the different printing elements 528.

In FIGS. 9 and 10, one example is illustrated in which printing element 528C of squad 526A is at an elevated temperature relative to printing element 528M of squad 526 and in which printing element 528M of squad 526B is at an elevated temperature relative to printing element 528C of squad 526, wherein little or no temperature deltas exist between printing elements 528M and 528C of squad 526C. In other examples or other circumstances, different firing frequencies and durations during printing upon a print media or different thermal characteristics of the printing elements may result in different temperature deltas or different temperature relationships between different color printing elements each individual squad 526. In such circumstances, controller 540 dynamically adjusts to the different temperature profiles as indicated by the signals received from temperature sensors 430 to output different control signals to reduce differences or level out/smooth out such temperature differences in similar fashion to that described above.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. An apparatus comprising:

printing elements, each of the printing elements comprising a die having a width, a length greater than the width, and a row of nozzles extending along the length from a first end of the row to a second end of the row, the printing elements comprising a first printing element and a second printing element; and a controller to output control signals to adjust a temperature of one of the printing elements based upon a temperature of another of the printing elements, wherein the control signals are to result in a first amount of heat being applied to a portion of the first printing element proximate the first end of the row and a second amount of heat, different than the first amount of heat, being applied to a second portion of the first printing element proximate the second end of the row.

2. The apparatus of claim 1, wherein each of the printing elements is dedicated to a single color of ink.

3. The apparatus of claim 1, wherein each of the printing elements has a thickness of less than or equal to 300 μm.

4. The apparatus of claim 3, wherein each of the printing elements has a length along which nozzles extend and a width of less than or equal to 500 μm.

5. The apparatus of claim 1, wherein first printing element is dedicated to printing a first color and a second printing element dedicated to printing a second color, wherein the apparatus further comprises:

a first sensor to sense a first temperature of the first printing element; and a second sensor to sense a second temperature of the second printing element, wherein the controller is to compare the first temperature and the second temperature and wherein the control signals upwardly adjust a lower one of the first temperature and the second temperature.

6. The apparatus of claim 1, wherein each of the first printing element and the second printing element comprise temperature sensors to sense different zones lengthwise along the respective printing element, wherein the control signals output by the controller are based upon temperature differences between an end most zone of the first printing element and an end most zone of the second printing element adjacent the end most zone of the first printing element.

7. The apparatus of claim 6, wherein the control signals output by the controller cause non-fluid ejecting heat to be applied to the end most zone of the first printing element in absence of non-fluid ejecting heat to the end most zone of the second printing element.

8. The apparatus of claim 1, wherein the first printing element is dedicated to printing a first color and wherein the second printing element is dedicated to printing a second color different than the first color, wherein the control signals output by the controller adjust a temperature of the first printing element based upon a temperature of the second printing element.

9. The apparatus of claim 1, wherein each of the printing elements has, extending lengthwise along the printing element, a first end most zone, an intermediate zone and a second end most zone and wherein the control signals output by the controller, that are based upon a temperature of another of the printing elements, cause the first end most zone to be heated to a temperature greater than a temperature of the second end most zone.

10. The apparatus of claim 1, wherein the first printing element is dedicated to printing a first color of ink, wherein the second printing element is dedicated to printing the first color of ink, the apparatus further comprising a third printing element dedicated to printing a second color of ink different than the first color of ink, wherein the control signals output by the controller adjust a temperature of the second printing element based upon a temperature of the first printing element and the third printing element.

11. The apparatus of claim 1, wherein the signals are to result in the temperature of a first end portion of the first printing element having a temperature greater than a temperature of an intermediate portion of the first printing element and an end portion of the second printing element that is adjacent the end portion of the first printing element having a temperature less than a temperature of an intermediate portion of the second printing element.

12. The apparatus of claim 1, wherein the signals are to result in adjusting a temperature of a first zone of the first printing element based upon the temperature of the second printing element and differently adjusting a temperature of a second zone of the first printing element based upon a temperature of the third printing element proximate to the first printing element.

13. The apparatus of claim 1, wherein the signals are to form a gradual ramped temperature transition from a first temperature of a first portion of first printing element to a second temperature of a second portion of the second printing element.

14. An apparatus comprising:

printing elements; and a controller to output control signals to adjust a temperature of one of the printing elements based upon a temperature of another of the printing elements, wherein the printing elements comprise a first printing element and a second printing element, each of the first printing element and the second printing element comprising nozzles extending along a length of the respective printing element and temperature sensors to sense different zones lengthwise along the respective printing element, wherein the control signals output by the controller are based upon temperature differences between an end most zone of the first printing element and an end most zone of the second printing element adjacent the end most zone of the first printing element.

15. The apparatus of claim 14, wherein the printing elements comprise a first printing element and a second printing element and wherein the signals are to result in adjusting a temperature of a first portion of the first printing element based upon the temperature of the second printing element and differently adjusting a temperature of a second portion of the first printing element based upon a temperature of the third printing element proximate to the first printing element.

16. The apparatus of claim 14, when the printing elements comprise a first printing element and a second printing element and wherein the signals are to form a gradual ramped temperature transition from a first temperature of a first portion of first printing element to a second temperature of a second portion of the second printing element.

17. An apparatus comprising:

printing elements; and a controller to output control signals to adjust a temperature of one of the printing elements based upon a temperature of another of the printing elements, wherein each of the printing elements has, extending lengthwise along the printing element, a first end most zone, an intermediate zone and a second end most zone and wherein the control signals output by the controller, that are based upon a temperature of another of the printing elements, cause the first end most zone to be heated to a temperature greater than a temperature of the second end most zone.

18. The apparatus of claim 17, wherein the printing elements comprise a first printing element and a second printing element and wherein the signals are to result in adjusting a temperature of a first portion of the first printing element based upon the temperature of the second printing element and differently adjusting a temperature of a second portion of the first printing element based upon a temperature of the third printing element proximate to the first printing element.

19. The apparatus of claim 17, when the printing elements comprise a first printing element and a second printing element and wherein the signals are to form a gradual ramped temperature transition from a first temperature of a first portion of first printing element to a second temperature of a second portion of the second printing element.

* * * * *